US007347054B2

(12) United States Patent
Rameau et al.

(10) Patent No.: US 7,347,054 B2
(45) Date of Patent: Mar. 25, 2008

(54) SYSTEM FOR HEATING TANKS OF LIQUEFIED GAS BY INDUCTION

(75) Inventors: Guillaume Rameau, Grenoble (FR); Valère Laurent, La Tronche (FR); Thierry Breville, Vaulnaveys le Bas (FR)

(73) Assignee: L'Air Liquide, Societe Anonyme A Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 308 days.

(21) Appl. No.: 11/002,626

(22) Filed: Dec. 2, 2004

(65) Prior Publication Data

US 2005/0132720 A1 Jun. 23, 2005

(30) Foreign Application Priority Data

Dec. 4, 2003 (FR) ..... 03 50969

(51) Int. Cl.

| | |
|---|---|
| ***F17C 7/04*** | (2006.01) |
| ***F17C 9/02*** | (2006.01) |
| ***B67D 5/00*** | (2006.01) |
| ***H05B 6/10*** | (2006.01) |

(52) U.S. Cl. ..... 62/48.1; 222/3; 219/628

(58) Field of Classification Search ..... 62/48.1; 222/3; 219/628

See application file for complete search history.

(56) References Cited

U.S. PATENT DOCUMENTS

| | | | | |
|---|---|---|---|---|
| 3,936,625 A * | 2/1976 | Burnett | 219/630 |
| 4,013,742 A * | 3/1977 | Lang | 261/130 |
| 5,286,942 A * | 2/1994 | McFadden et al. | 219/630 |
| 5,761,911 A | 6/1998 | Jurcik et al. | |
| 5,773,798 A * | 6/1998 | Fukumura | 219/631 |
| 6,076,359 A | 6/2000 | Jurcik et al. | |
| 6,199,384 B1 | 3/2001 | Udischas et al. | |
| 6,474,076 B2 * | 11/2002 | Wang et al. | 62/48.1 |
| 6,734,405 B2 * | 5/2004 | Centanni et al. | 219/628 |

FOREIGN PATENT DOCUMENTS

| | | |
|---|---|---|
| DE | 35 30 806 | 1/1987 |

(Continued)

OTHER PUBLICATIONS

International Search Report for PCT/FR03/50969.

(Continued)

*Primary Examiner*—William C Doerrler
(74) *Attorney, Agent, or Firm*—Brandon Clark

(57) ABSTRACT

The invention relates to a system for delivering gas stored in a vessel in liquefied form, said vessel having in its lower part a liquefied phase of said gas and in the upper part a gaseous phase of said gas, which vessel includes a means for connecting to a means for utilization as well as a means for heating the lower part of said vessel. In accordance with the invention, the liquefied gas and/or the shell of the vessel are electrically conductive elements and the means for heating comprises an electromagnetic induction means capable of producing an alternating magnetic field in the shell and/or the liquid so as to heat the shell in its lower part and/or the liquid in the vessel, all while limiting the heating of the gas by said means.

14 Claims, 9 Drawing Sheets

FOREIGN PATENT DOCUMENTS

| | | |
|---|---|---|
| EP | 0 844 431 | 5/1998 |
| FR | 1 602 691 | 1/1971 |
| FR | 2 834 045 | 6/2003 |
| WO | WO 03 031892 | 4/2003 |

OTHER PUBLICATIONS

Patent Abstracts of Japan, vol. 0122, No. 29 (M-714), Jun. 29, 1988; & JP 63 026498 (Koike Sanso Kogyo Co., Ltd.), Feb. 4, 1988.

* cited by examiner

SYSTEM FOR HEATING TANKS OF LIQUEFIED GAS BY INDUCTION

This application claims the benefit of priority under 35 U.S.C. §119 (a) and (b) 1 to French Application No. 0350969, filed Dec. 4, 2003, the entire contents of which are incorporated herein by reference.

BACKGROUND

The present invention concerns a system for the delivery of gas stored in a vessel in liquefied form, said vessel including in its lower part a liquefied phase of said gas and in the upper part a gaseous phase of said gas, this vessel including a means for connecting the vessel to a means for utilization as well as a means for heating the lower part of said vessel.

The semiconductor industry is today confronted with growing needs for so-called specialty gases for the various steps necessary for the fabrication of integrated circuits. Some of these specialty gases, such as HCl, $Cl_2$, HBr, $N_2O$, $NH_3$, $WF_6$, $BCl_3$, and 3MS, to cite only some of them, liquefy at ambient temperature, and because of this fact pose difficulties in their distribution. These difficulties are directly related to their pressure and/or their flow rate during utilization.

A liquefied gas is composed of two phases, liquid and gaseous, in equilibrium with each other. This equilibrium implies that at a given temperature a liquefied gas has a well-determined pressure and that this pressure varies as a function of the temperature according to a relationship that is specific to each gas. Thus, FIG. 1 shows an equilibrium curve for the liquid and vapor phases of trimethylsilane (referred to as 3MS), which indicates the pressure of the gas in equilibrium above the liquid phase as a function of temperature. It is found that the pressure increases as the temperature increases, and vice versa.

When the gaseous phase is withdrawn from a tank of liquefied gas, part of the liquid must be converted into gas to regenerate the gas in proportion to the amount used in order to maintain the equilibrium. The liquid thus begins to boil using the available energy (typically the energy of the external medium surrounding the tank). As the rate of withdrawal is increased, this energy requirement will increase, and the liquid will boil violently, thus creating a substantial risk of entrainment of impurity-loaded droplets in the gaseous phase. These droplets not only contaminate the gas but also accelerate corrosion processes and cause instabilities with regard to regulation of the flow rate and pressure measurements. If the available energy is insufficient to gasify the liquid and thus regenerate the vapor phase, the temperature—and thus the pressure—will drop since the equilibrium must be maintained.

An external contribution of energy through heating makes it possible to limit the cooling and pressure drop observed. Several solutions are thereby conceivable.

One solution illustrated by FIG. 1 comprises heating the foot or bottom of the tank while controlling the heating using the pressure in the tank. Heating is allowed when the pressure is below the pressure that corresponds to ambient temperature, and heating is stopped when the liquid reaches or is at ambient temperature. By keeping the gas at a temperature slightly below ambient temperature, it is possible to avoid having to lay out the distribution network under the restriction that there be no cold point along it. Such a system is described in U.S. Pat. Nos. 5,761,911, 6,076,359, and 6,199,384.

In general the heating techniques used up to now to increase the flow rates of liquefied gases comprise heating the body of the tank using a resistive heating element of the heating belt or heating ribbon type, or even hot air. This type of heating has the drawback that energy transfer is substantially limited by the thermal conduction from the heating element to the tank, which results in a limitation of the usable flow rate despite a substantial energy input. In other words, such installations have a low energy efficiency.

More generally there is the problem of increasing the flow rate for a gas coming from a tank where the gas is stored in liquid form. Another technical problem arises when it is desired to increase the pressure of the gas delivered by the tank above its equilibrium pressure with respect to the liquid in the tank at ambient temperature. In both of these cases one solution that can be employed is that described in the patents referenced above, by increasing the power transferred by the heating system. In this case, it is quickly established that the heating system can reach a temperature above 100° C., the heating energy being transmitted by conduction to the tank and/or to the liquid, producing an increase in the temperature of the tank, at least locally, such that impurities absorbed on the tank walls, such as CO, $CO_2$, etc., undergo desorption, which results in the delivery of gas containing impurities such as CO, $CO_2$, etc., which is unacceptable for the user, particularly in the field of semiconductor fabrication (but also in other technical fields).

Thus, we are today confronted with the problem of increasing the flow rate and/or the pressure of the gas delivered by a reservoir (tank, etc.) without producing additional impurities, which would run counter to the intended purpose (since on the contrary the vaporization of the gas already makes it possible to eliminate the impurities present in the liquid that are not readily vaporizable).

SUMMARY

In one aspect of the present invention a system for delivering gas stored in a vessel is provided. The system of the present invention includes a vessel comprising a lower part, an upper part, a shell, a heating zone, a means for connecting, a means for utilization, and a means for heating. This lower part contains a liquefied phase of said gas and this upper part containing a gaseous phase of said gas. This heating zone comprises an element selected from the group consisting of said liquefied gas, said shell, and said liquefied gas and said shell. This heating zone further comprises electrically conductive elements, and this means for heating comprises an electromagnetic induction means capable of creating an alternating magnetic field in the heating zone so as to heat the heating zone.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
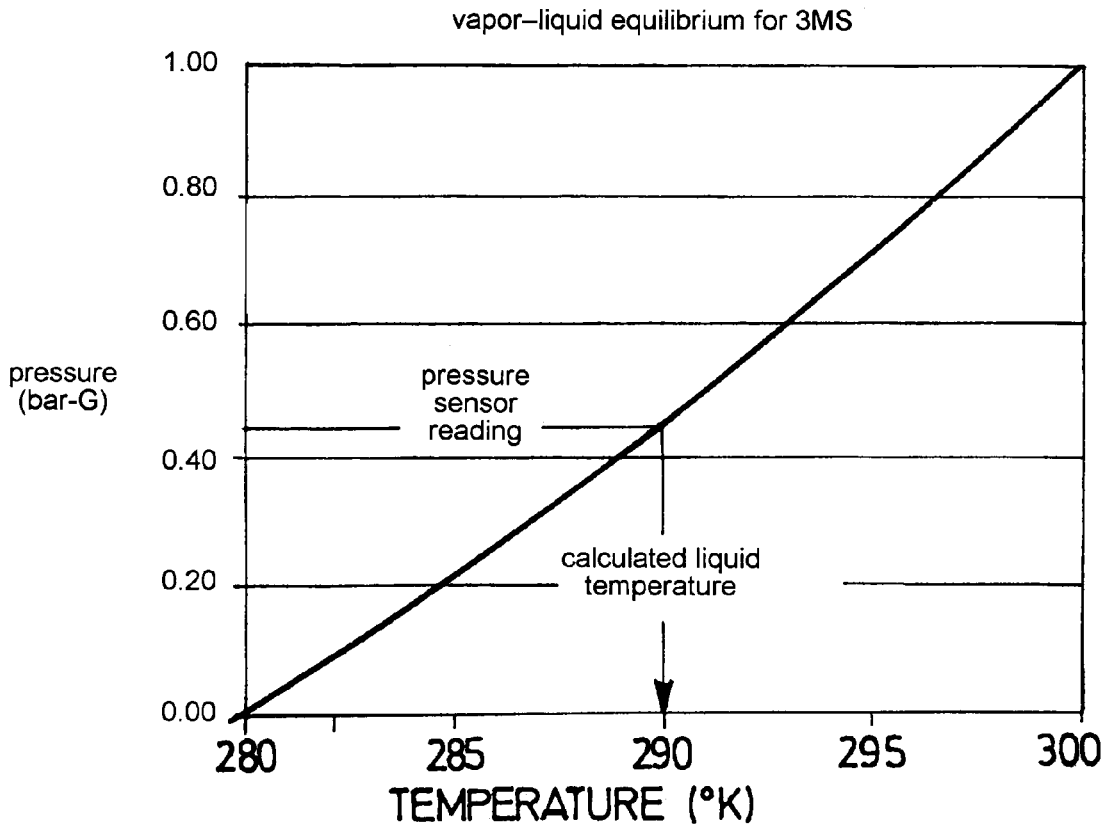
FIG. 1 illustrates an equilibrium curve for the liquid and vapor phases of trimethysilene.

In one aspect of the present invention a system for delivering gas stored in a vessel is provided. The system of the present invention includes a vessel comprising a lower part, an upper part, a shell, a heating zone, a means for connecting, a means for utilization, and a means for heating. This lower part contains a liquefied phase of said gas and this upper part containing a gaseous phase of said gas. This heating zone comprises an element selected from the group consisting of said liquefied gas, said shell, and said liquefied gas and said shell. This heating zone further comprises electrically conductive elements, and this means for heating comprises an electromagnetic induction means capable of creating an alternating magnetic field in the heating zone so as to heat the heating zone. As used in this invention, the terms vessel and tank refer to any container for fluids, which include, but are not limited to, a tank, cylinder, reservoir, drum, canister, barrel, etc.

The system in accordance with the invention makes it possible to overcome these drawbacks and is characterized in that the liquefied gas and/or the shell of the vessel are electrically conductive elements and in that the means for heating comprises means for electromagnetic induction capable of creating an alternating magnetic field in the shell and/or the liquid so as to heat the shell in its lower part and/or the liquid in the vessel. The proposed invention comprises heating tanks of liquefied gas by induction: it has been found that a very superior efficiency is obtained that can reach 80 to 90% for steel, for example. Induction heating makes it possible to move away from the transfer of energy by conduction since the currents induced by the inductor directly heat the material of the tank within its thickness. Thus, a performance is produced that is found to be five to ten times higher than the performance of a heating system using a heating element of equal installed power, for example, for a liquefied gas such as $C_4F_8$, without bringing about substantial desorption of impurities from the surface of the vessel.

The invention can in particular serve to respond to two types of demands that can be generated by a user of gas stored in a vessel, particularly in liquid form.

The first type of demand can be, for example, to provide the gas in gaseous form at a point of utilization at a pressure above the equilibrium pressure of the gas with the liquid in the tank at ambient temperature (when the tank is not heated). In this case, the invention makes it possible to heat the tank and/or the liquid (or the gas) without causing the desorption of impurities from the inner surface of the tank and without risks in terms of use safety, as the temperature of the vessel in the vicinity of the means for heating by electromagnetic induction remains low and does not pose a danger for the user. Impurity desorption remains limited to the extent that the pressure called for at the point of utilization corresponds to a temperature of the liquefied gas in the reservoir that is 5 to 10° C. higher than the ambient temperature at most (or a temperature of 30° C. typically). This heating means can be positioned at a height corresponding to the liquid inventory in the vessel, but preferably over the entire height of the tank.

The second type of demand can be to increase the flow rate of gas at the outlet from the vessel over that for the case in which said vessel is not heated, but doing this without substantially increasing the temperature of the walls of the vessel (in general, a value less than 35° C. for the outside temperature of the vessel) in order to avoid the desorption of impurities from said walls.

The invention can thus be applied to the distribution of specialty liquefied gases, to the conversion of liquefied gases into the gaseous phase, in particular for their packaging and purification. The invention allows the transfer time to be considerably reduced, thus improving the productivity of the installation. In addition, the invention offers the advantage of avoiding the elevated surface temperatures (40-50° C.) that promote the desorption of light species such as CO and $CO_2$ into the product. The surface temperature of the tank generally does not exceed approximately 30° C. with induction heating as described in the present invention. When a transfer takes place from a first vessel to a second vessel, it will preferably be ensured that the second vessel is cooled sufficiently that the gas in the second vessel is condensed at least as fast as it is evaporated in the first vessel.

The invention is not limited to the heating of small-capacity tanks (50 liters or less). It is applicable to any type of reservoir, wherein the inductor is then adapted to the geometry of said reservoir and the generator is controlled to function with this inductor.

The alternating magnetic field is preferably created using a generator operating at a frequency between 50 Hz and 4 MHz.

Though it is possible to use the mains frequency (50 Hz or 60 Hz) or high frequencies, it is preferable, in order to limit costs, to use a medium-frequency generator, that is, a generator of frequencies between 1 kHz and 100 kHz. The inductor is then made of either Litz wire or metal ribbon, or of cooled metal tube, and for each type of material to be heated the impedance of the resonating circuit (inductor plus load plus balancing capacitances) is matched as closely as possible to the characteristic impedance of the generator. The inductor is preferably positioned around the foot of the tank or under the base of the tank when the vessel is a tank and around the bottom of the vessel or below the bottom of the vessel when it is a vessel other than a tank.

The heating means preferably comprises at least one turn of a conductor, preferably encircling at least 90% of the vessel.

When the inductor is to be placed under the bottom of the vessel, its shape can be adapted to each type of vessel bottom. In general, to achieve heating at a minimal effectiveness, the means for electromagnetic induction heating in accordance with the invention will consist of at least one turn of conducting wire of any cross section, generally with a thickness of at least 1 mm (with or without ferrites being arranged, generally with even spacing, along this turn). This means for electromagnetic induction heating can extend from the lower part of the vessel (or can even be situated below the vessel, with at least one turn below the vessel at a minimum when the intention is to heat the underpart of the vessel) to the top of the vessel. The lower part of the vessel can have one or more turns running solely under the vessel (for example, the base of a tank) or only from the lower side portion of the vessel, when a tank is involved, or a combination of the two, in particular when the vessel is one that has bottom and side walls that form a single continuous surface, as is the case for the vessels in FIG. 8 and subsequent figures as described below.

In general, however, when the intent is to increase the flow rate of the gas from the vessel to the user, the means for electromagnetic induction heating will be placed solely at the lower part of the vessel (contrary to the case described above where it can be located at any position), preferably at a height that corresponds as much as possible to that of the liquid in the vessel. In the case of an inductor placed around the foot of the tank, the height of heating will typically be limited to 50 mm. In any case, the objective is to concentrate the heating on the liquid phase in order to be able, for example, to use control of the temperature in proportion to the pressure (as described in the patents cited above). In effect, tanks of liquefied gas (or other vessels) are never completely emptied by the user. It is found that if the heating height on the vessel is limited to a height corresponding to at most 5% by weight of the liquid contained in the vessel, there is a near certainty of always heating only the liquid, which is generally the goal sought when the intent is to increase the flow rate of the gas from the vessel.

A generator is preferably used that makes it possible to operate with several types of inductors according to the material and diameter of the tanks to be heated. Taking into account the favorable efficiency of induction heating, it is possible to control the heating of two or more tanks simultaneously from a single generator.

It is also possible to use a single inductor that preferably would make at least a turn over the tank with the largest diameter whose use is planned and that is wrapped on top of itself or in a helix for tanks of smaller diameter. This solution makes it possible to reduce the number of inductors necessary but leads to a lower efficiency. Nevertheless, tests have shown that even in this configuration the gas flow rates are more than 5 times higher than those that can be achieved using resistive heating systems (test conducted on $C_4F_8$ in 10-liter and 50-liter tanks).

The tests were carried out using a half-bridge generator of the type used in industrial induction baking with a Litz wire inductor (wire made of multiple fibers insulated from one another and twisted). Other embodiments are possible such as an industrial type generator (half bridge or full bridge, series or parallel circuit)—used particularly in the iron and steel industry or in heat treatment—coupled to a water-cooled inductor. The efficiency is then even better. This is a solution particularly suited to heating tanks or vessels made of aluminum.

In general, any type of generator capable of automatic frequency adaptation can be employed, coupled with an inductor preferably made of Litz wire, a metal sheet, or a metal tube with the stipulation that the inductor be properly dimensioned and the adaptation to the generator be properly controlled. It is also possible to use a fixed-frequency generator provided that in this case the value of the capacitance for compensation of reactive energy is optimized as a function of the nature of the tank to be heated; it is also possible to use a pilotable variable-frequency generator if it is adapted to the resonance frequency of the oscillation circuit.

Each inductor can be made of Litz wire, metal strap, or cooled metal tube (for example, a hollow tube in which a cooling fluid circulates), with or without ferrite in each case, and made of one or more layers in each case. The inductor is preferably placed on the vessel in such a way that the heating will be concentrated on the liquid phase of the liquefied gas. But the invention is also applicable to the case of a vessel containing a fluid that is in the supercritical state.

Figure 2:
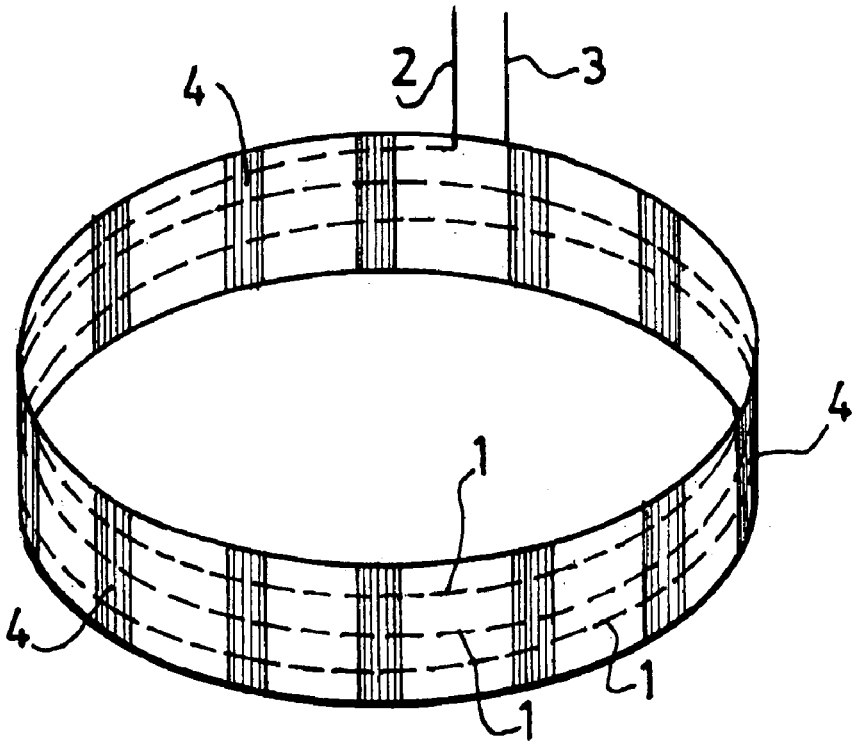
FIG. 2 illustrates a first type of closed inductor for a cylindrical tank in accordance with one illustrative embodiment of the present invention.

The invention will be understood better with the help of the following examples of embodiments, given as nonlimiting examples, together with the figures, which represent the following:

FIG. 2 represents a first type of inductor called a "standard cylinder" inductor. This inductor is dimensioned in such a way that it fits the diameter of the tank. It comprises insulating material in which a conductor 1 is wound in the form of turns 10. It is installed by sliding it lengthwise along the tank. The number of turns 10 is adapted to the material of the tank, as indicated above. The set of turns 10 (connected with one another in series and/or parallel) form an induction winding whose ends 2 and 3 are connected to an adjustable-frequency alternating current generator (not shown in FIG. 2). Elements made of ferrite or magnetic sheet 4 (transformer type) can be installed around the inductor to concentrate the magnetic field toward the interior of the inductor, and the inductor itself can be made in multiple layers. The "standard" inductor, although more problematic since it must be adapted to each tank diameter and each material, is the one that offers the best results.

Figure 3:
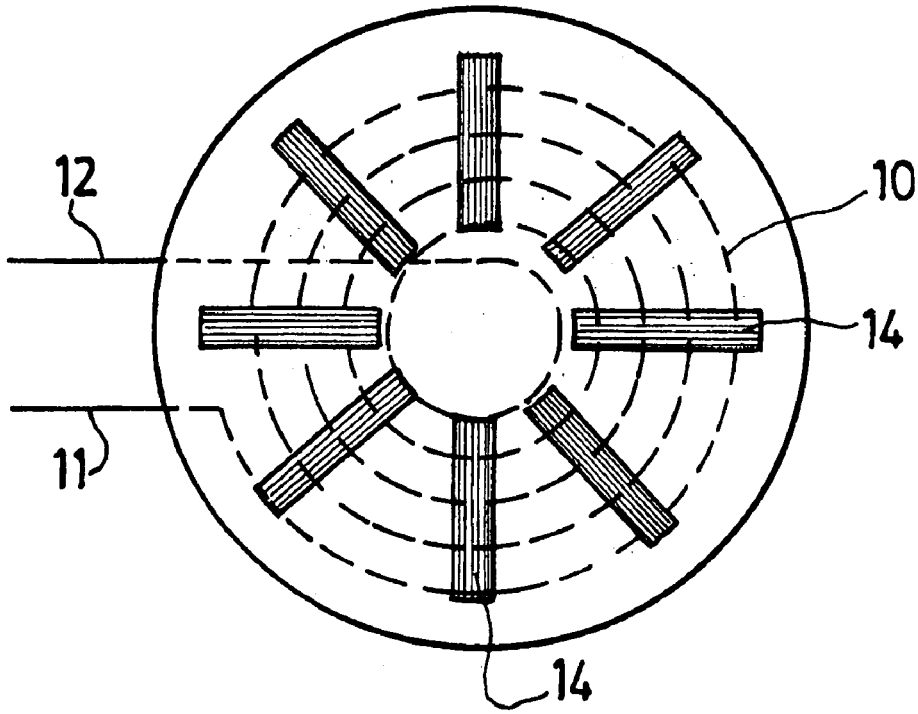
FIG. 3 illustrates a second type of inductor for a cylindrical tank in accordance with one illustrative embodiment of the present invention.

FIG. 3 represents a second type of inductor called a "standard pancake" inductor. This inductor is placed under the base of the tank and is adapted to the geometry of the tank. It consists of an insulating material containing concentric turns 10 of electric wire connected at 11, 12 to the alternating current generator. The number of turns is in turn also adapted to the material to be heated. Elements made of ferrite or magnetic sheet 14 (transformer type) can be installed on the interior face of the inductor to concentrate the magnetic field toward the bottom of the tank, and the inductor itself can be arranged in multiple layers.

The connection of the turns in series-parallel makes it possible to adjust the impedance of the circuit to match that of the generator.

Figure 4:
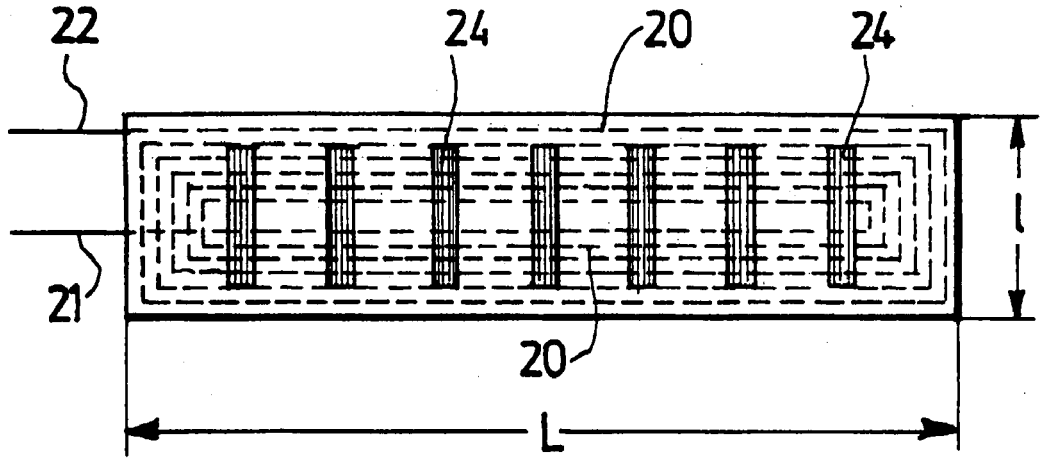
FIG. 4 illustrates a third type of inductor for a tank in accordance with one illustrative embodiment of the present invention.

FIG. 4 represents a third type of inductor called a "pancake belt" inductor. This inductor can be wound around the foot of the tank. It is made of flexible insulating material on which the turns are wound and is rectangular in shape in the figure (but any shape that can be wound around this tank could be considered). It is dimensioned (L) in such a way that it will make at least one turn of the tank of the largest diameter. Its height (I) is limited so as to heat only the foot of the tank (which generally is oriented vertically). For tanks of smaller diameters, it can be wound upon itself or wound in a helix around the foot of the tank. Its number of turns 20 depends on the material to be heated. Elements 24 made of ferrite or magnetic sheeting (transformer type) can be installed around the inductor to concentrate the magnetic field toward the interior of the inductor, and the inductor itself can be constructed in multiple layers. A current or voltage generator is connected to the ends 21 and 22 of the conductor 20. This solution—(called a "pancake belt inductor")—although it does not provide the best energy efficiency, is nonetheless amply sufficient in numerous applications, the flow rates of gas issued from a tank containing liquefied gas being 5 to 10 times higher than those obtained using traditional heating systems.

Figure 5:
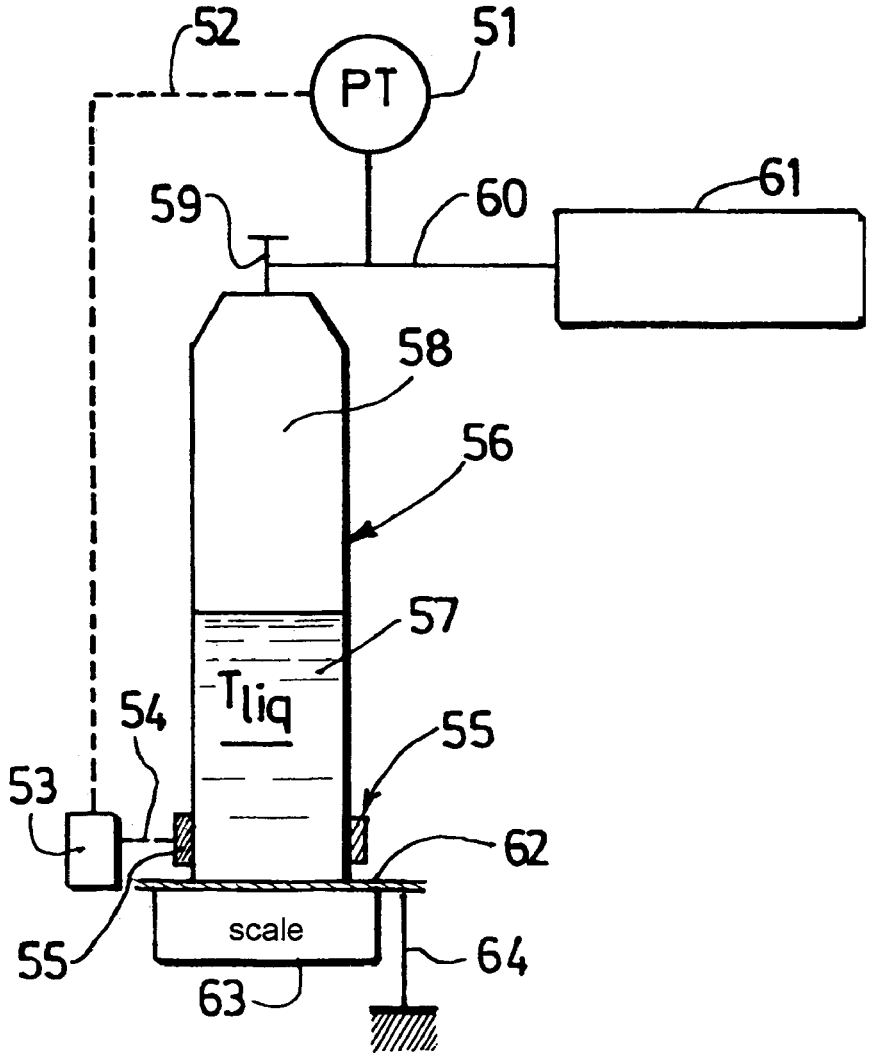
FIG. 5 illustrates a first example of use of the invention with side heating of the base of the tank.

FIG. 5 describes a first variant of the implementation of the heating of a tank of liquefied gas in accordance with the invention.

The tank 56 contains in its lower part a liquid 57 to be vaporized and above the liquid 57 a gaseous phase 58 of this same liquid, the gas being conducted to the utilization equipment 61 through the intermediacy of the valve 59 and the line 60. Connected to the line 60 is a means 51 for measurement of the pressure of the gas coming from the tank 56. This pressure means is connected (electrically, for example) via the dashed line 52 to the generator 53, to initiate the operation of the generator when the measured pressure is below a certain setpoint value and stop the generator when the measured pressure is above the setpoint value. When the generator 53 is started, this causes an alternating current to circulate in the inductor 55 (as described, for example, in FIG. 2 or 4) via the electrical connection line 54, which causes heating of the tank 56 (and/or possibly the liquid 57) by electromagnetic induction. The fact that only the lower part of the tank and/or liquid is heated causes a circulation of the liquid in the tank due to the difference in temperature between the upper surface of the liquid and the lower part of the liquid (which promotes uniformity of heating of the liquid). To monitor the progress of the inventory in the tank, a scale 63 is placed under the tank 56 with a sheet (of copper generally) 62 between the tank and the scale, the sheet possibly being grounded by the line 64, so as to avoid influence by the magnetic field on the scale.

Figure 6:
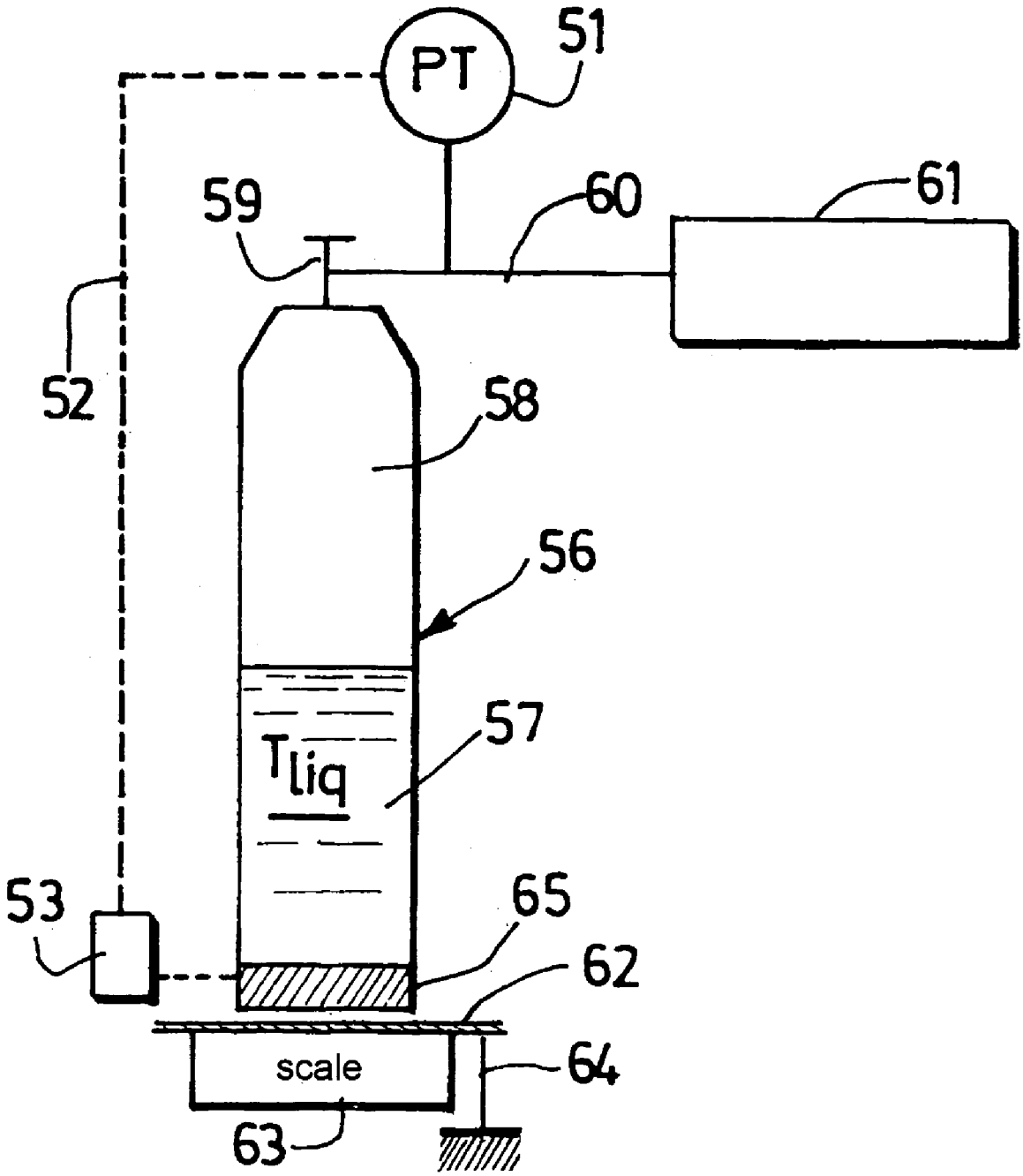
FIG. 6 illustrates a second example with heating through the bottom.

FIG. 6 represents a variant of FIG. 5 that operates in the same manner, the inductor of FIG. 2 or 4 being replaced by an inductor, for example, of the type described in FIG. 3 placed under the tank 56.

Figure 7:
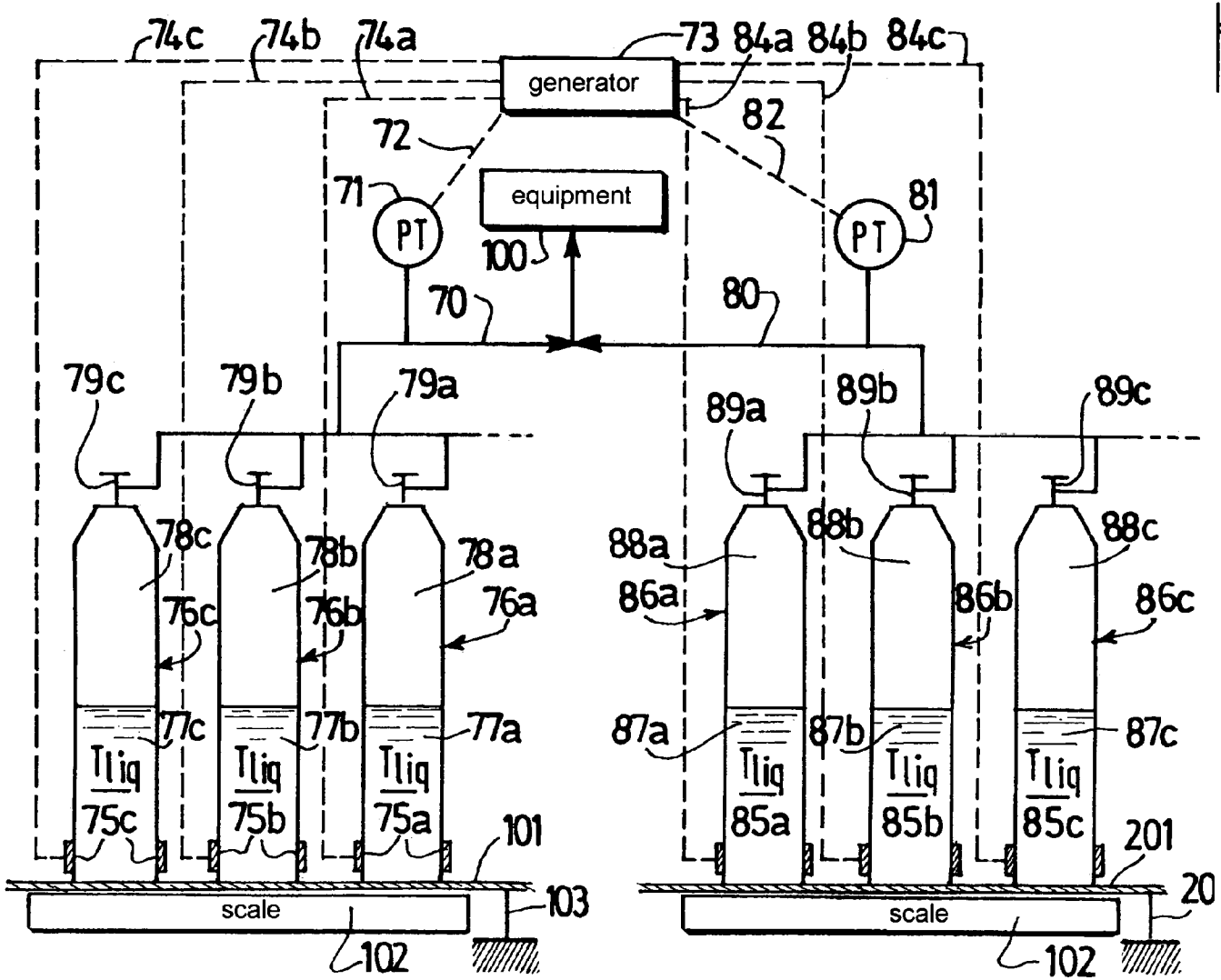
FIG. 7 illustrates an example of a multi-tank embodiment.

FIG. 7 represents a multi-tank system wherein each tank is equipped with a system in accordance with the invention (either variant from FIG. 5 or 6, with a single means for pressure measurement per group of tanks); the systems for distribution of liquefied gas in the semiconductor industry frequently use two (or more) tanks, which are used in an alternating manner when the pressure of one of them falls below a certain threshold. The control means then coordinates switching from one tank to another so as not to interrupt distribution of the gas. The multi-tank set of FIG. 7 includes n tanks 76*a*, 76*b*, 76*c*, (see left part of the figure) connected via the valves 79*a*, 79*b*, 79*c*, . . . and the line 70 to the equipment 100 and n other identical tanks 86*a*, 86*b*, 86*c*, . . . (see right part of the figure) to which "switching" takes place when the pressure in tank 76 falls below a predetermined value, that is, when the gas has been withdrawn too rapidly from the tank or when the tank is empty. The tanks 86 are respectively connected via the valves 89*a*, 89*b*, and 89*c* and the line 80 to the equipment 100.

The pressure measurement means 71 and 81 measure the pressure of the gas, respectively, in the zones 70 and 80 and a signal (electrical) is sent via 72 and 82, respectively, to the generator 73, which sends an alternating electrical signal via the lines 74*a*, 74*b*, 74*c*, . . . for one part and 84*a*, 84*b*, 84*c*, . . . to the inductors, respectively, 75*a*, 75*b*, 75*c*, and 85*a*, 85*b*, 85*c*, . . . for induction heating of the liquid 77*a*, 77*b*, 77*c*, . . . and 87*a*, 87*b*, 87*c* . . . so as to produce the gas 78*a*, 78*b*, 78*c*, . . . and 88*a*, 88*b*, 88*c*, . . . respectively, when that is necessary. A sheet 101, 201 is also placed between the base of the tanks and the scale 102, 202 with grounding 103, 203.

The generator 73 can, with the use of a pressure sensor 71, 81 for n tanks, manage the heating of the necessary n inductors 75, 85 in series, in parallel, and/or in sequential mode. When the pressure of the n tanks (on the one side) falls below a predefined threshold, the automation switches over to the n tanks on the other side, which thereby ensures continued distribution. The tanks that have been switched out continue to be heated until their pressure rises to the pressure corresponding to the ambient temperature so they can take up the relay if necessary. The induction heating system in accordance with the invention makes it possible to rapidly return to the gas pressure corresponding to the ambient temperature, in comparison to heating systems by conduction from the prior art. FIG. 7 depicts the inductor of FIG. 2. The inductors in FIGS. 3 and 4 could also be used.

Figure 8:
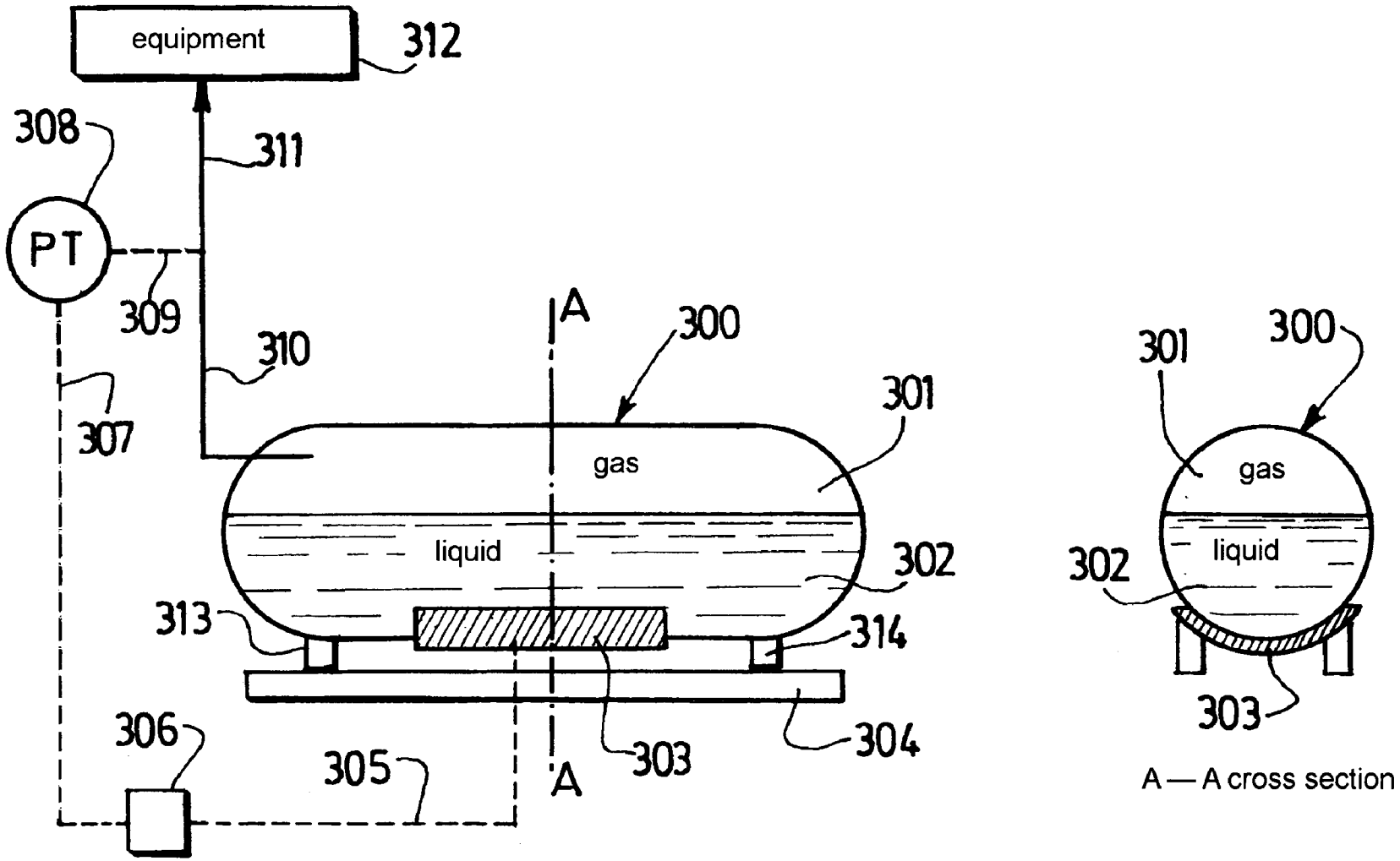
FIG. 8 illustrates an example of an embodiment of the invention for gas contained in a large-capacity reservoir of any shape.

To ensure the distribution of a liquefied gas at very high flow rates, reservoirs more voluminous than the traditional tanks are sometimes used. An example of an embodiment of the invention with this type of reservoir is represented in FIG. 8. The typical capacity of such reservoirs is approximately 450 liters to 1,000 liters.

In FIG. 8 a reservoir 300 containing a liquid 302 and a gas 301 is supported, via intervening feet 313, 314, by a scale 304. The heating inductor 303 is positioned below and right up against the reservoir (see cross section A-A). It is electrically connected by the line 305 to the generator 306, which receives a control signal via the line 307 from the pressure sensor 308. This is connected via 309 to the gas line 310 coming from the reservoir 300 and via the line 311 to the equipment 312. The operation is identical to that described previously. The inductor (made of one or more elements connected in series and/or parallel) has the proper shape to conform to the lower part of the reservoir 300, over a more or less substantial length (in both directions).

Figure 9:
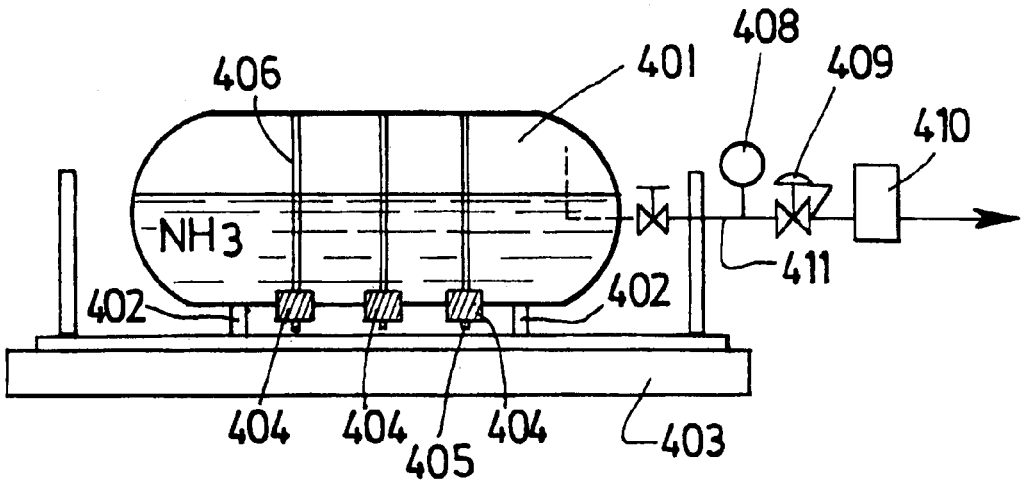
FIG. 9 illustrates another example of an embodiment of the invention with a large-capacity reservoir.

FIG. 9 represents another example of an embodiment of the invention applied to large-capacity reservoirs, also known as a "Ton-Tank" (a reservoir generally oriented horizontally). Multiple inductors branched in parallel 404 are used in FIG. 9 to distribute the heating power over the reservoir 401. Each inductor 404 has ferrites 405 that make it possible to concentrate the magnetic field and improve the efficiency. The reservoir 401 rests on a scale 403 and is connected to a distribution line 411 that has a pressure sensor 408, a pressure regulator 409, and a flowmeter 410. The inductors used are of the "pancake belt" type used flat and are represented in FIG. 4. They are installed below the bottom of the reservoir 401 between the reservoir support elements 402 with the aid of bands 406 that pass around the reservoir.

The system of FIG. 9 was tested with ammonia $NH_3$ in liquefied form. The process of fabrication of liquid crystal flat panels (LCD screens), known also as TFT ("thin film transistor") screens, employs high-purity gaseous ammonia ($NH_3$). Flow rates on the order of 500 to 1,000 L/min are necessary for these fabrications. $NH_3$ is a liquefied gas with a low standard density but with a very high heat of vaporization (approximately 1200 $kJ \cdot kg^{-1}$) For this reason it is particularly difficult to distribute at such flow rates since the necessary heating power becomes very high.

The process in accordance with the invention, by virtue of its excellent energy efficiency, makes it possible to limit the installed heating power. Tests performed on a 450-L reservoir showed that a nominal power on the order of 8 kW sufficed to obtain a flow rate of 500 slm while maintaining the pressure in the reservoir. A theoretical calculation makes it possible to show that at ambient temperature (20° C.), a power of approximately 7 kW is necessary to vaporize 500

L/min of $NH_3$, this without including the smaller thermal losses. Power measurements at the outlet of the induction generator in tests indicated values of approximately 7.5 kW, which is to say that the efficiency between the energy received by the vessel and the energy effectively used to evaporate ammonia was close to 90%. Use of induction heating made it possible to show that a much shorter response time was obtained according to the invention. Less than half an hour was necessary to preheat 250 kg ammonia contained in a 450-L reservoir from 10° C. to 22° C., compared to several hours required with traditional resistive heating.

Figure 10:
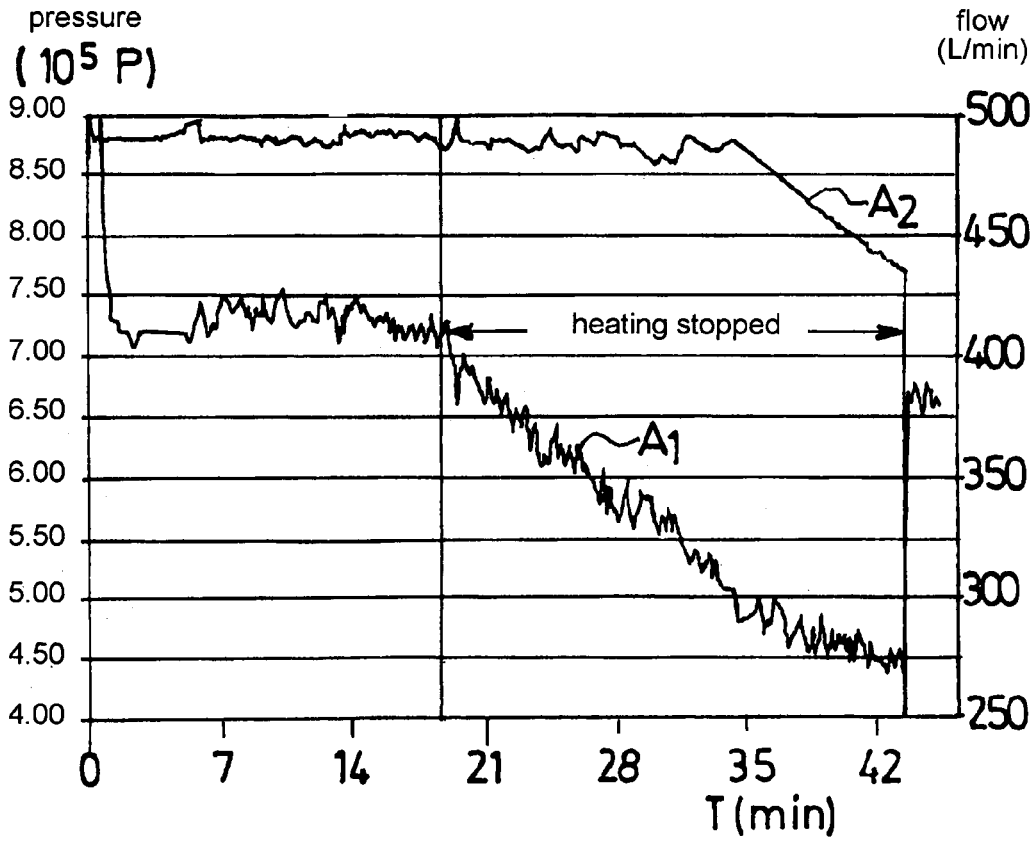
FIG. 10 illustrates shows the performances obtained with the system in FIG. 9.

The performance obtained with a 450-L reservoir of $NH_3$ for a flow rate of 500 L/min is summarized in FIG. 10. Curve $A_1$ represents the pressure of the gas (in absolute value) expressed in $10^5$ pascal as a function of time expressed in minutes. Curve $A_2$ represents the flow rate of the gas in L/min (converted, like all the measurements of flow rate in the present application, to the value at standard conditions of temperature and pressure, that is, to "standard liters per minute" or slm—according to the U.S./British designation) as a function of time. Heating of the vessel is stopped at time T in FIG. 10 (approximately 19 minutes after the start of the withdrawal). The pressure of the gas, which was maintained constant between 7 and $7.5\times10^5$ Pa despite gas withdrawal, declined when heating was stopped (T), curve $A_1$. On the other hand, the flow rate of the liquid was maintained a good 10 minutes after cessation of the heating, with the ammonia benefiting from the energy previously stored during the heating.

The invention applies preferably to liquefied gases, but also to vessels containing only a gaseous phase or only a supercritical phase in the same vessel. It applies particularly to so-called specialty gases (notably $SF_6$, $N_2O$, $NH_3$, HCl, $Cl_2$, etc.) utilized in the production of semiconductors (particularly the precursors) as well as gases of the $CO_2$ type (gaseous and/or liquid and/or supercritical) or even of the acetylene type (or other welding gases or gases used in welding).

COMPARATIVE EXAMPLE

The example below was carried out on tanks of identical volume (10 L), all containing $C_4F_8$.

Two types of heating are compared:

- heating of the foot of the tank using a 1-kW resistive belt composed of high power density elements linked to one another,
- heating by induction with a generator capable of delivering a power of approximately 900 W-1 kW.

Figure 12:
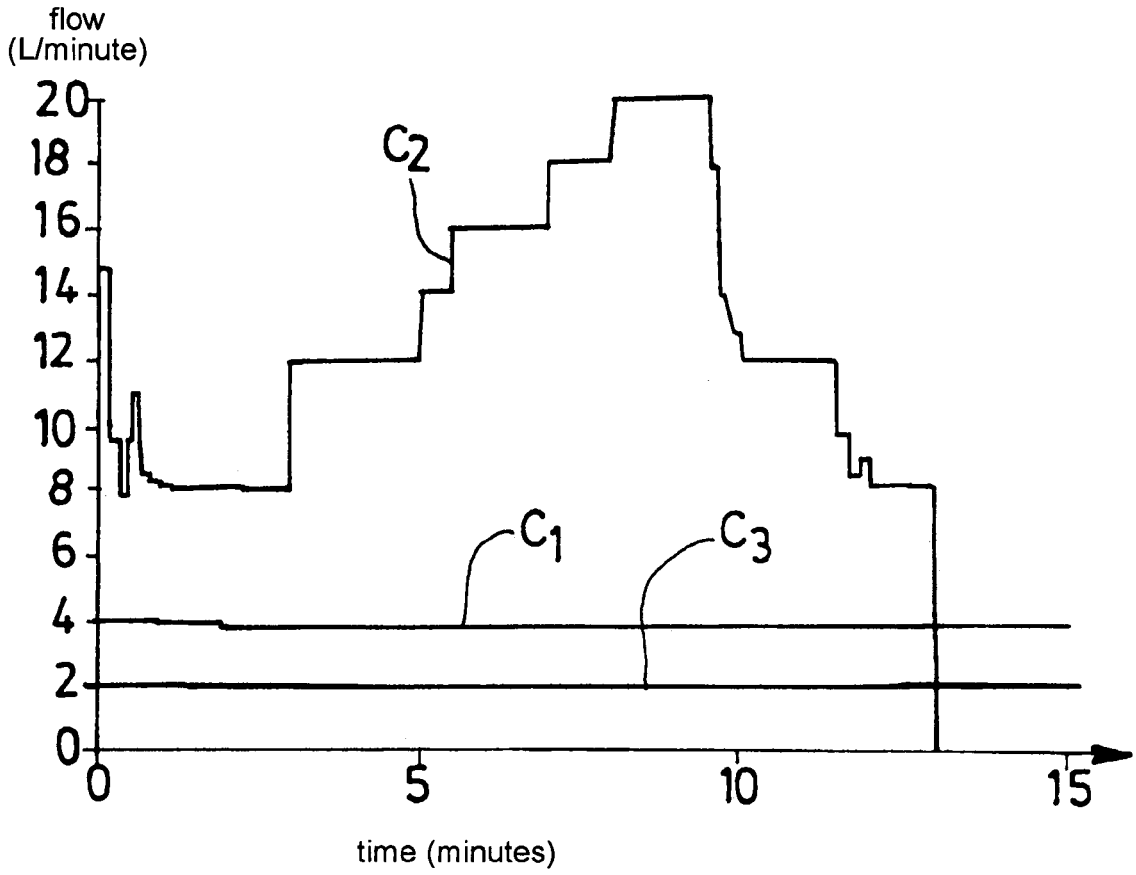
FIG. 12 illustrates gas flow rate variation curves for gas issuing from a tank for the case of the prior art and the case of the invention.

For reference, a test was also carried out without heating. FIG. 12 shows the flow rates of gaseous $C_4F_8$ withdrawn in each case:

- curve $C_1$ corresponds to heating with the resistive belt,
- curve $C_2$ corresponds to heating by induction in accordance with the invention,
- curve $C_3$ corresponds to the absence of heating.

The curves in FIG. 12 clearly show the benefit of the invention (curve $C_2$) in relation to the use of a resistive electric belt having the same nominal power. The flow rates obtained are on the order of 5 times higher (20 L/min compared to 4 L/min). By comparison, the flow rate in accordance with the invention is ten times higher than in the case where no heating of the tank takes place.

The Various Applications of the Invention:

A first application for which the heating of liquefied gas reservoirs in accordance with the invention can offer a real advantage is the distribution of these liquefied gases at a very high flow rate.

In a first case the invention can be applied using the pressure of the tank to monitor the heating. The liquid-vapor equilibrium curve of the liquefied gas makes it possible to know at any time the value of the temperature of the liquid in the interior of the reservoir. It is thus possible to heat the reservoir just the amount necessary to maintain the pressure such that ambient temperature is not exceeded. Provided that there is no colder point along the distribution lines downstream, this makes it possible to avoid the heating of said distribution lines as the risk of recondensation of the gas in the distribution line is then avoided.

In a second case, it is possible to apply the invention to keep the temperature of the reservoir constant. Heating of the distribution lines downstream then becomes indispensable when the temperature to be maintained at the reservoir is higher than the ambient temperature along the distribution lines.

The invention can be applied to the packaging of liquefied gases by transfer in the gaseous phase: the ability to withdraw a gaseous phase at high flow rates from a reservoir of liquefied gas makes it possible to package this liquefied gas in other packages. The flow rates obtained through the use of heating in accordance with the invention make it possible to appreciably increase the productivity of such installations, insofar as the cooling capacity for the packages intended to receive the liquefied gas is at least equivalent to that of the induction heating.

This type of transfer in the gaseous phase offers the advantage of purifying the liquefied gas since it amounts to the execution of a single-stage distillation. In addition, induction makes it possible to limit the temperature of the surface of the parent reservoir, thus avoiding desorption from the walls of the reservoir of volatile species that could contaminate the liquefied gas.

Figure 11:
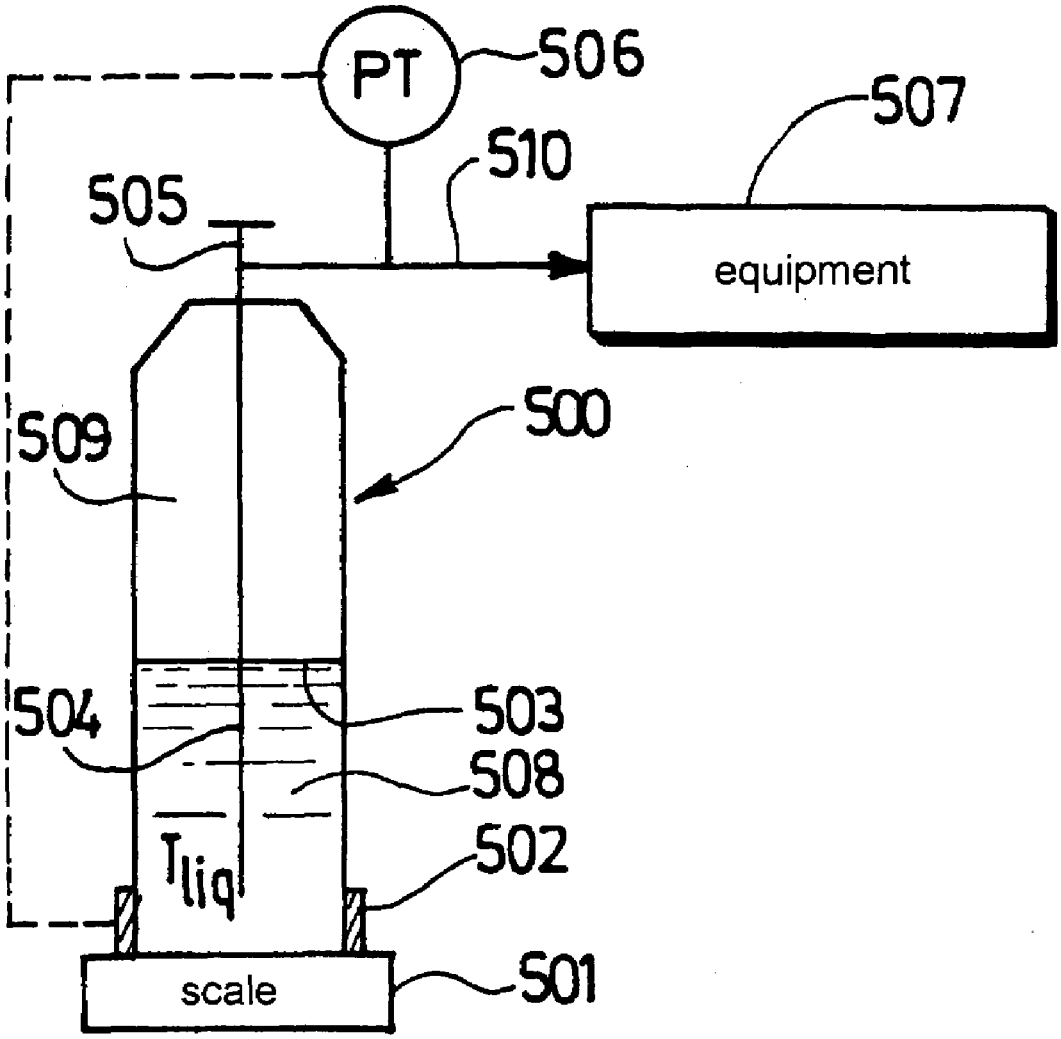
FIG. 11 illustrates an example of application of the invention in the case of withdrawal of liquid into a tank.

Another application of the invention comprises withdrawing the gas in its liquid form into a tank: the gas can be pushed in liquefied form through a dip tube using its own vapor pressure rather than using a carrier gas such as nitrogen, for example, which runs the risk of dissolution in the liquefied gas. In this case one proceeds, for example, as described in FIG. 11: in this figure the tank 500 rests on the scale 501 (in order to monitor its weight, and thus its emptying). At the foot of the tank there is arranged an inductive ribbon 502 as described above with its associated generator that heats the liquid 508, which vaporizes into 509: the pressure of the gas in 509 increases in such a way that the liquid 508 can rise in the dip tube 504, pass through the valve 505, and be distributed through the piping 510 to the equipment 507 in liquefied form. Monitoring of pressure regulation 506 is also provided on line 510, controlling the heating of 502.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A system for delivering gas stored in a vessel, wherein:

a) said vessel comprising a lower part, an upper part, a shell, a heating zone, a means for connecting, a means for utilization, and a means for heating;

b) said lower part containing a liquefied phase of said gas;

c) said upper part containing a gaseous phase of said gas; and d) said heating zone comprising an electrically conductive element selected from the group consisting of said liquefied gas, said shell, and said liquefied gas and said shell;

wherein said means for heating comprises an electromagnetic induction means capable of creating an alternating magnetic field in said heating zone so as to heat said heating zone; and wherein said electromagnetic induction means further comprises a magnetic element installed thereon and adapted to concentrate said magnetic field toward said electrically conductive element.

2. The system of claim 1, wherein said vessel receives said gas in liquefied form.

3. The system of claim 1, wherein said alternating magnetic field is produced using an electric generator operating at a frequency between 50 Hz and 4 MHz.

4. The system of claim 3, wherein said electric generator supplies several inductors.

5. The system of claim 1, wherein said vessel is placed on a scale to monitor the liquid level therein.

6. A system for delivering gas stored in a vessel, wherein:

a) said vessel comprising a lower part, an upper part, a shell, a heating zone, a means for connecting, a means for utilization, and a means for heating;

b) said lower part containing a liquefied phase of said gas;

c) said upper part containing a gaseous phase of said gas; and d) said heating zone comprising an element selected from the group consisting of said liquefied gas, said shell, and said liquefied gas and said shell;

wherein said heating zone further comprises electrically conductive elements;

wherein said means for heating comprises an electromagnetic induction means capable of creating an alternating magnetic field in said heating zone so as to heat said heating zone;

wherein said vessel is placed on a scale to monitor the liquid level therein; and wherein a sheet of electrical conductor is placed between said electromagnetic induction means and said scale to protect said scale from magnetic field disturbances.

7. The system of claim 1, wherein said heating means comprises at least one turn of a conductor.

8. The system of claim 7, wherein said conductor encircles at least 90% of a diameter of said vessel.

9. The system of claim 7, wherein each turn comprises a conducting wire having a thickness of at least 1 mm.

10. The system of claim 1, wherein said vessel is a tank, generally oriented vertically.

11. The system of claim 1, wherein said vessel is of the generally horizontally oriented "Ton-Tank" type.

12. The system of claim 1, wherein said vessel is a cylinder.

13. Utilization of the system of claim 1 to provide a gas to a point of utilization at a pressure above the equilibrium pressure of the gas with the liquid in the tank at ambient temperature.

14. Utilization of the system of claim 1 to increase the flow rate of the gas without substantially increasing the temperature of the walls of the vessel.

* * * * *